US005770858A

United States Patent [19]

Fuchs et al.

[11] Patent Number: 5,770,858

[45] Date of Patent: Jun. 23, 1998

[54] MICROCHANNEL PLATE-BASED DETECTOR FOR TIME-OF-FLIGHT MASS SPECTROMETER

[75] Inventors: Wolfram B. Fuchs, Brimfield; Bruce N. Laprade, Holland, both of Mass.; Brian A. Lincoln, Woodstock, Conn.

[73] Assignee: Galileo Corporation, Sturbridge, Mass.

[21] Appl. No.: 810,228

[22] Filed: Feb. 28, 1997

[51] Int. Cl.[6] ..... H01J 49/40

[52] U.S. Cl. ..... 250/287; 250/305; 250/397; 313/103 CM; 313/105 CM

[58] Field of Search ..... 250/287, 305, 250/397; 313/103 CM, 105 CM, 103 R

[56] References Cited

U.S. PATENT DOCUMENTS 4,295,073 10/1981 Freeman et al. .
4,672,193 6/1987 Duchenois et al. .
4,731,538 3/1988 Gray .
4,950,939 8/1990 Tosswill .
4,988,868 1/1991 Gray .
5,030,878 7/1991 Roy et al. .
5,039,851 8/1991 Green et al. .
5,166,521 11/1992 Hayashi et al. ..... 250/287
5,326,978 7/1994 Aebi et al. .
5,349,185 9/1994 Mendenhall ..... 250/287
5,374,826 12/1994 LaRue et al. .
5,391,874 2/1995 Ellis .
5,493,111 2/1996 Wheeler et al. .
5,565,681 10/1996 Loewenhardt et al. .

*Primary Examiner*—Kiet T. Nguyen
*Attorney, Agent, or Firm*—Watson Cole Grindle Watson, P.L.L.C.

[57] ABSTRACT

A detector assembly for a time-of-flight (TOF) mass spectrometer has a modular microchannel plate (MCP)-based detector and a replaceable MCP cartridge containing at least one MCP secured within the detector. The detector includes an integrated support for a voltage divider and high voltage connections. The detector is also adapted to be secured to a modified vacuum flange for the instrument.

20 Claims, 6 Drawing Sheets

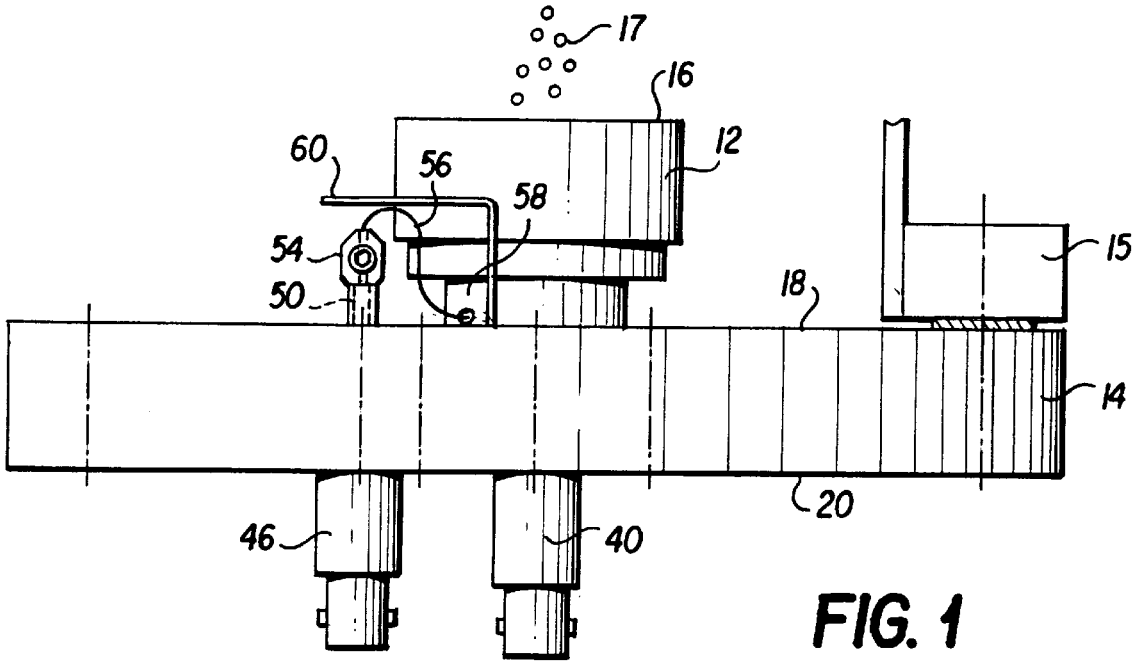
FIG. 1
FIG. 2
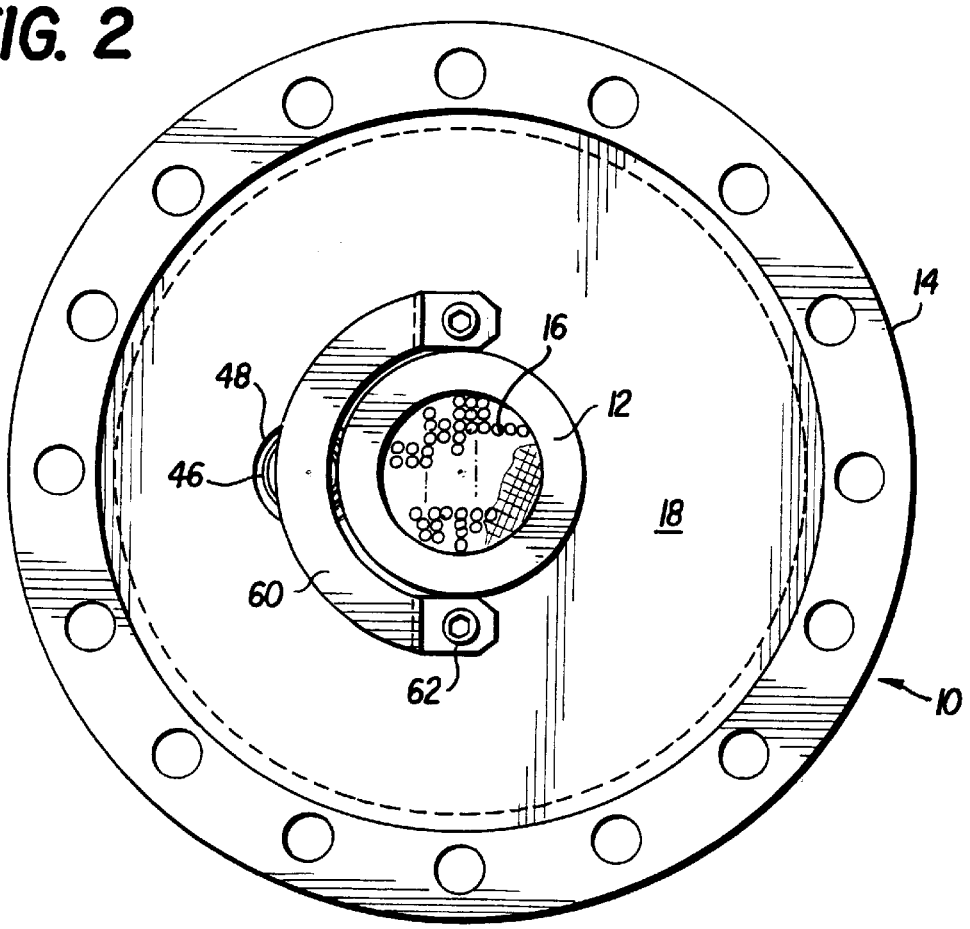

MICROCHANNEL PLATE-BASED DETECTOR FOR TIME-OF-FLIGHT MASS SPECTROMETER

BACKGROUND OF THE INVENTION

1. Field of the Invention

The invention relates to detectors for analytical instruments such as time-of-flight (TOF) mass spectrometers. In particular, the invention pertains to a modular microchannel plate (MCP)-based detector of reduced size for a TOF mass spectrometer.

2. Description of the Prior Art

A microchannel plate (MCP)-based detector is the device of choice in many analytical instrumentation applications. The compact nature, high-speed response and position sensing capability of the detector makes it ideal for applications in, for example, scanning electron microscopes (SEM), miniature residual gas analyzers, magnetic sector mass spectrometers, and time-of-flight mass (TOF) spectrometers. However, conventional detector arrangements are fragile, complex and relatively large, and do not allow for field replacement of the MCP. The detector must be returned to the factory for refurbishment. This is undesirable in terms of cost and out-of-service time for the instrument. In addition, the total number of parts required to manufacture a conventional detector is relatively high, thus adding to the cost.

SUMMARY OF THE INVENTION

It is an object of the invention to prove a modular MCP-based detector for an analytical instrument such as a TOF mass spectrometer having a replaceable MCP cartridge.

It is a further object of the invention to provide an MCP-based detector for a TOF mass spectrometer having an integrated voltage dividing means and high voltage connection unit of simplified design and reduced size.

The foregoing objects are achieved according to an exemplary embodiment of a detector assembly for a time-of-flight (TOF) mass spectrometer comprising a modular microchannel plate (MCP)-based detector having an input end for receiving charged and neutral particles, and a replaceable cartridge containing at least one MCP adapted to be secured within the detector. The detector includes an integrated voltage dividing means and high voltage connection means. The detector is also adapted to be secured to a modified vacuum flange of the spectrometer.

The invention is also directed to various constructions of the replaceable MCP cartridge. For example, the cartridge may include a plurality of stacked MCPs, a grid plate and spacers.

Other features and advantages of the invention will become apparent upon reference to the following description and drawings.

BRIEF DESCRIPTION OF THE DRAWINGS

FIG. 1 is a side elevation of a modular detector secured in a modified vacuum flange for use in a TOF mass spectrometer according to an exemplary embodiment of the invention;

FIG. 2 is a top plan view of the arrangement shown in FIG. 1;

DESCRIPTION OF THE INVENTION

Figure 3:
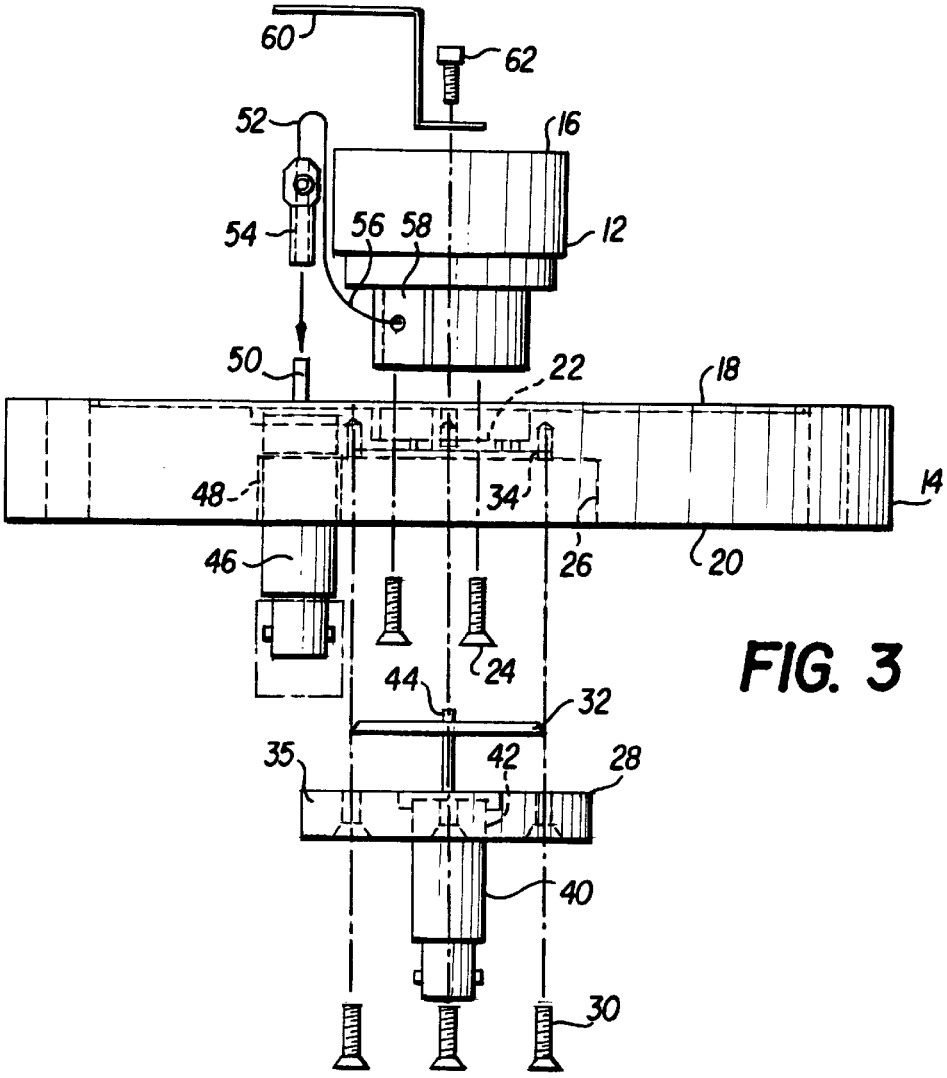
FIG. 3 is an exploded side elevation of the arrangement shown in FIG. 1.

FIGS. 1–4 illustrate a modular detector assembly 10 according to an exemplary embodiment of the invention, including a modular detector 12 secured in a modified vacuum flange 14 for use in a time-of-flight spectrometer 15 (shown as a fragment) (not shown). The detector 12 has an input end 16 for receiving charged or neutral particles 17, for example, electrons, ions and photons. The vacuum flange 14 has a vacuum side 18 and an atmosphere side 20. The detector 12 is adapted to be secured in a first recess 22 formed in the vacuum side 18 of the flange 14. A plurality of inboard screws 24 passing through the vacuum flange 14 secure the detector 12 within the recess 22, as shown.

The atmosphere side 20 of the vacuum flange 14 has a second recess 26 for receiving a secondary flange 28 which is secured to the vacuum flange 14 by a plurality of outboard screws 30. An O-ring 32 is located between respective confronting surfaces 34 and 35 of the secondary recess 26 and second flange 28. The O-ring 32 is sized so that it surrounds the inboard screws 24 and is inboard of the outboard screws 30 to secure the vacuum when assembled. An anode connector 40 is secured in vacuum tight relation in an opening 42 of the second flange 28, as shown. The anode connector 40 has a pin 44 which is adapted to engage an anode connector (not shown in FIG. 3, but hereinafter shown and described).

A high voltage connector 46 is secured in vacuum tight relation in an opening 48 of the vacuum flange 14, as shown. A conductive pin 50 extends through the vacuum side 18 of the flange 14. A flexible connector 52 is electrically connected to the detector 12, as shown, and has a free connector end 54 which is adapted to engage the pin 50 of the high voltage connector 46. A distal end 56 of the connector 52 is secured in a modular high voltage connector terminal 58.

A electrically conductive shield 60 is secured to the vacuum side 18 of the flange 14 by means of screws 62. In an exemplary embodiment, the screws 62 are of a so-called vented type which are known to those skilled in the art. The shield 60 is located in spaced relation with the vacuum flange and shades the flexible connector 52, connector end 54 and the pin 50 to shield the input end 16 of the detector 12 from stray electric fields produced by the high voltage connector.

Figure 4:
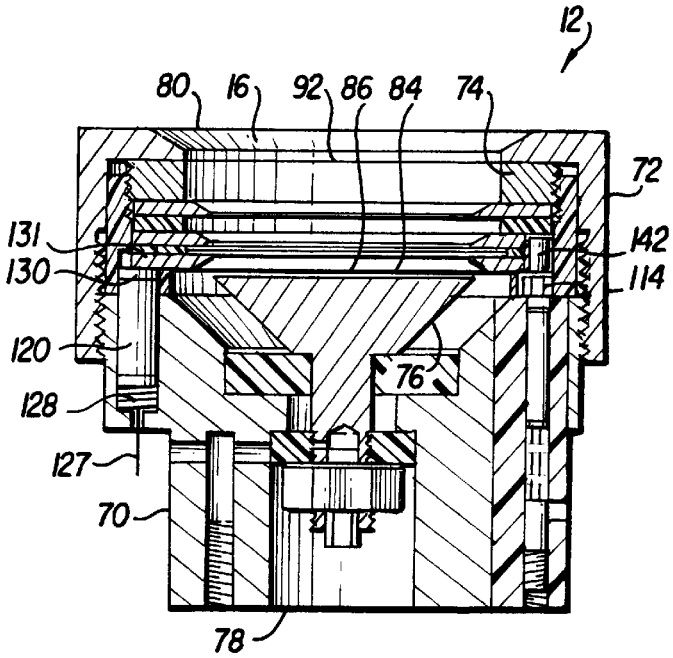
FIG. 4 is a side sectional view of a modular MCP-based detector according to an exemplary embodiment of the invention.
Figure 5:
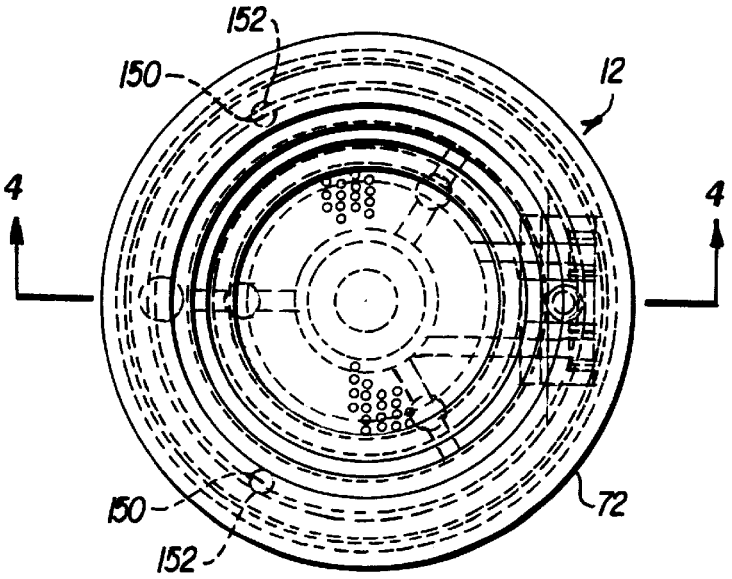
FIG. 5 is a to plan view of the detector shown in FIG. 4.
Figure 6:
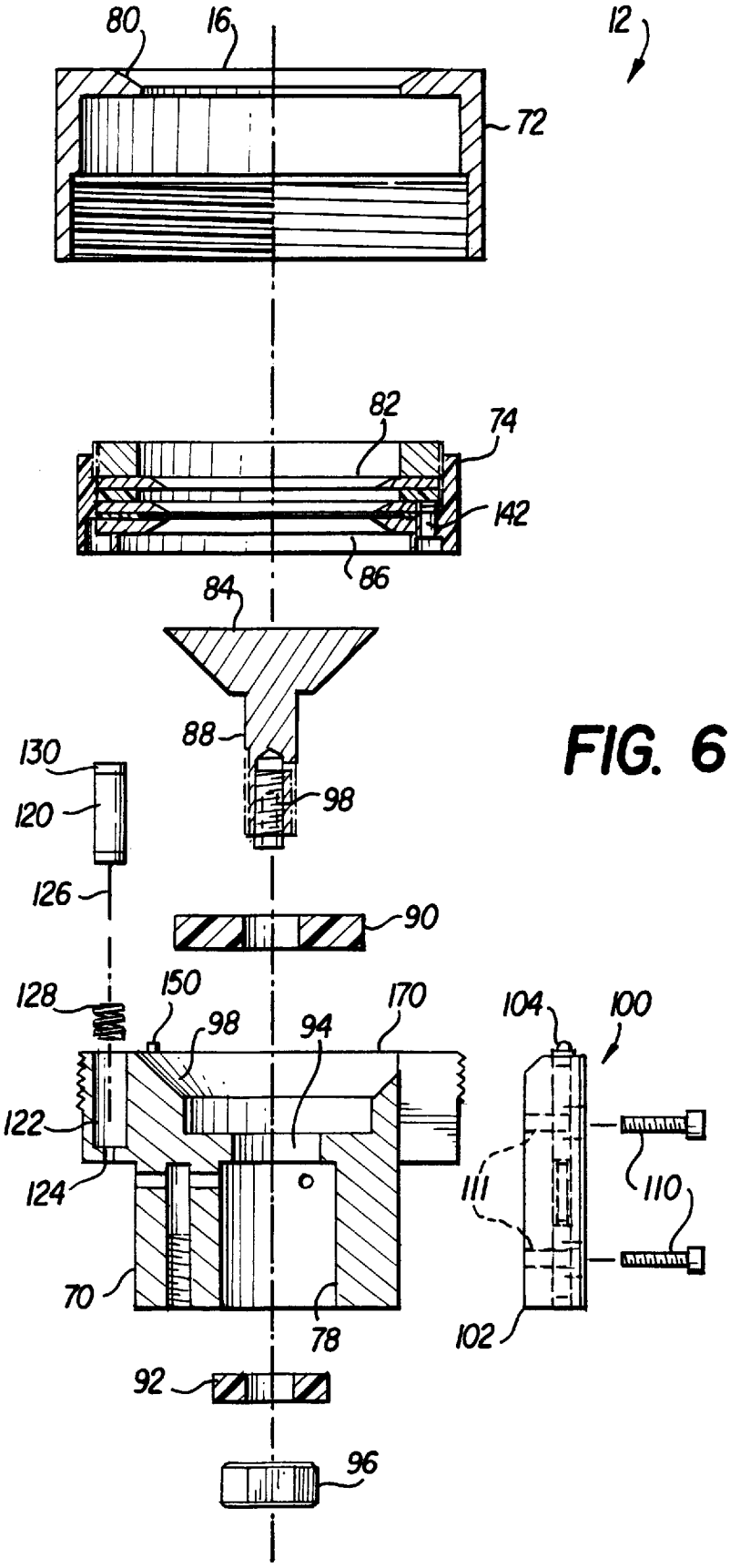
FIG. 6 is an exploded side sectional view of the detector shown in FIG. 4.
Figure 7:
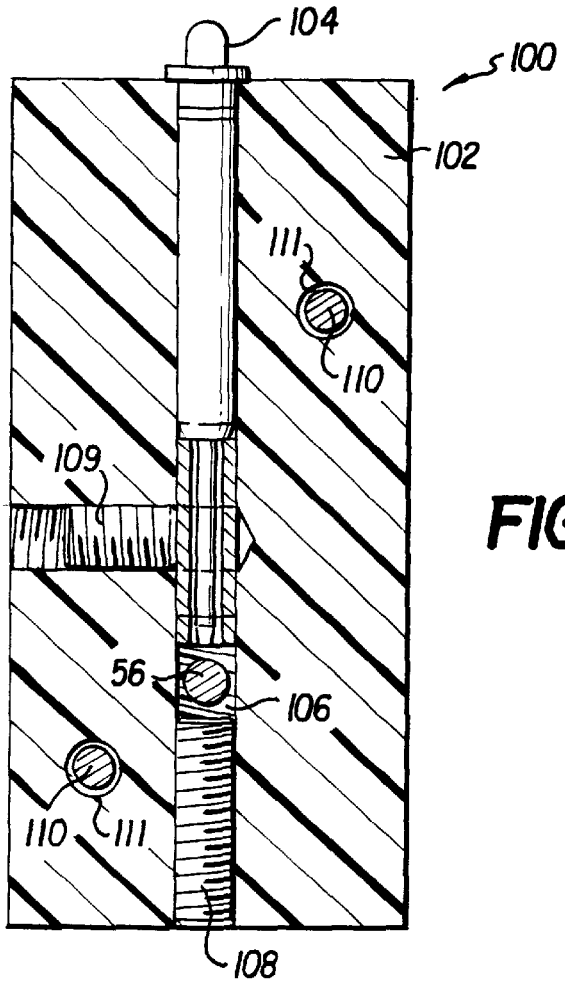
FIG. 7 is a cross-sectional view of a high voltage contact.

The modular detector 12 is illustrated in further detail in FIGS. 4–6 and includes base 70, a cap 72 and a removable MCP cartridge 74 which is captured between base 70 and the cap 72. The base 70 further includes a 50 Ω coaxial conical anode 76 secured in a stepped and tapered central opening 78 of the base 70. The cap 74 has an opening 80 formed at the input end 16 of the detector 12, for allowing the particles to enter the cartridge 74 at the input face 82. The anode 76 has a signal receiving face 84 in confronting relation with the output face 86 of the cartridge 74. The anode 76 tapers down the signal receiving surface 84 to a cylindrical tail piece 88. The anode 76 is held in spaced relationship with the base member 70 by first and second insulated washers 90 and 92 which engage opposite sides of a stepped wall 94. A threaded nut 96 and a threaded end 97 of the tail piece 88 secure the anode 76 in position, as shown. The tail piece 88 has a central opening 98 for receiving the anode pin 44, shown in FIG. 3, to thereby make electrical contact for carrying the output signal from the detector 12. The opening 78 has a tapered wall 98 in spaced relation with the tapered wall of the anode 76 and with the insulating dielectric washers 90 and 92, and the tail piece 88 establishes an impedance matched anode structure.

The detector 12 further includes an integrated high voltage connector unit 100 (FIG. 10) in the form of an insulated housing 102 having a spring loaded electrical connector 104 secured therein. The spring loaded connector 104 has a high voltage connector end opening 106 which is adapted to receive the distal end 56 of flexible connector 52 (FIG. 3). A screw 108 secures the high voltage connector end 56 in position, as shown. Set screw 109 secures the spring loaded connector 104 in position. Screws 110 secure the connector unit 100 to the base portion 70 through openings 111.

A spring loaded resistor 120 is located in an opening 122 having a through hole 124 in the lower side, as illustrated. The resistor 120 has a lead 126 which passes through the opening 124 and which is bent over at 127 (FIG. 4) to hold the resistor 120 in position. A spring 128 is captured between the bottom of the opening 122 in the resistor 120 for urging the resistor upwardly. A contact side 130 of the resistor engages an output electrode secured in the cartridge 74 which is hereinafter described. The resistor forms a voltage divider to drop the output electrode voltage.

Overall, the detector 12 has a relatively low profile about five times lower than a conventional device. In the exemplary embodiment shown, the detector has a height to width ratio near about one.

Figure 10:
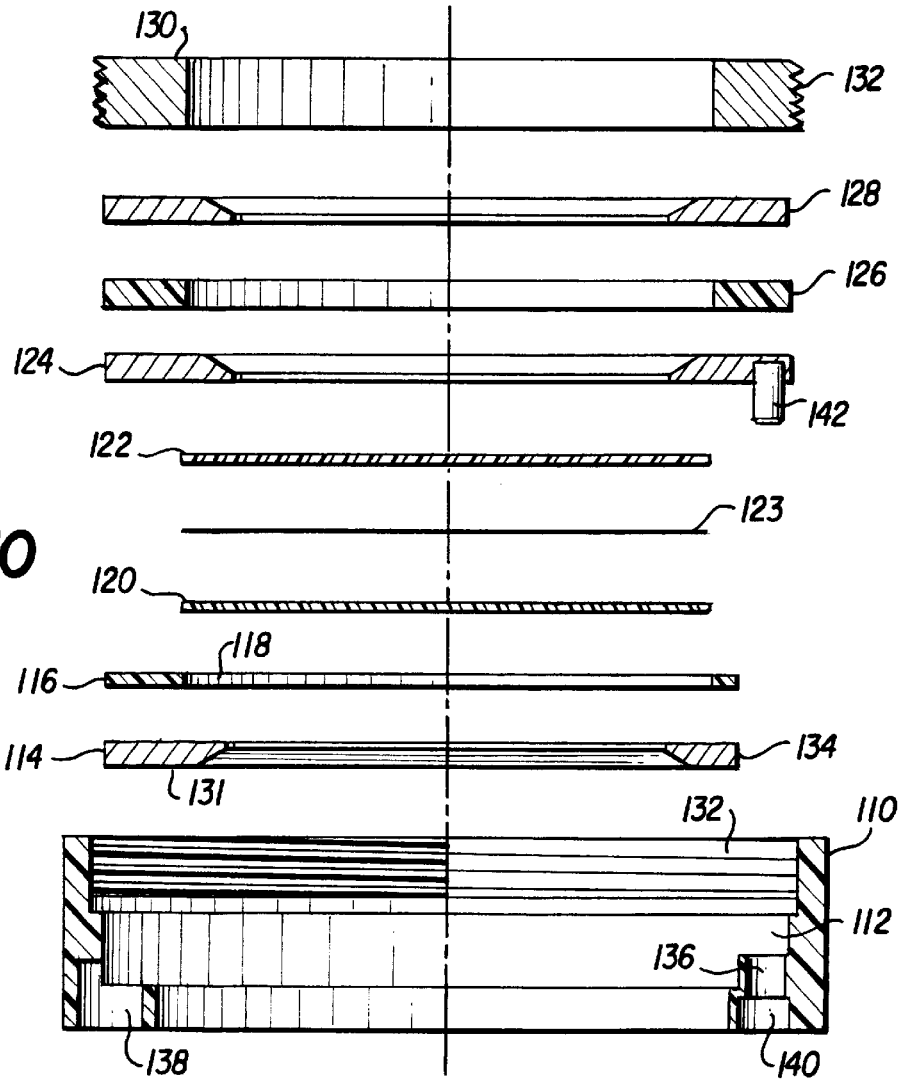
FIG. 10 is an exploded side sectional view of the cartridge shown in FIG. 8.
Figure 8:
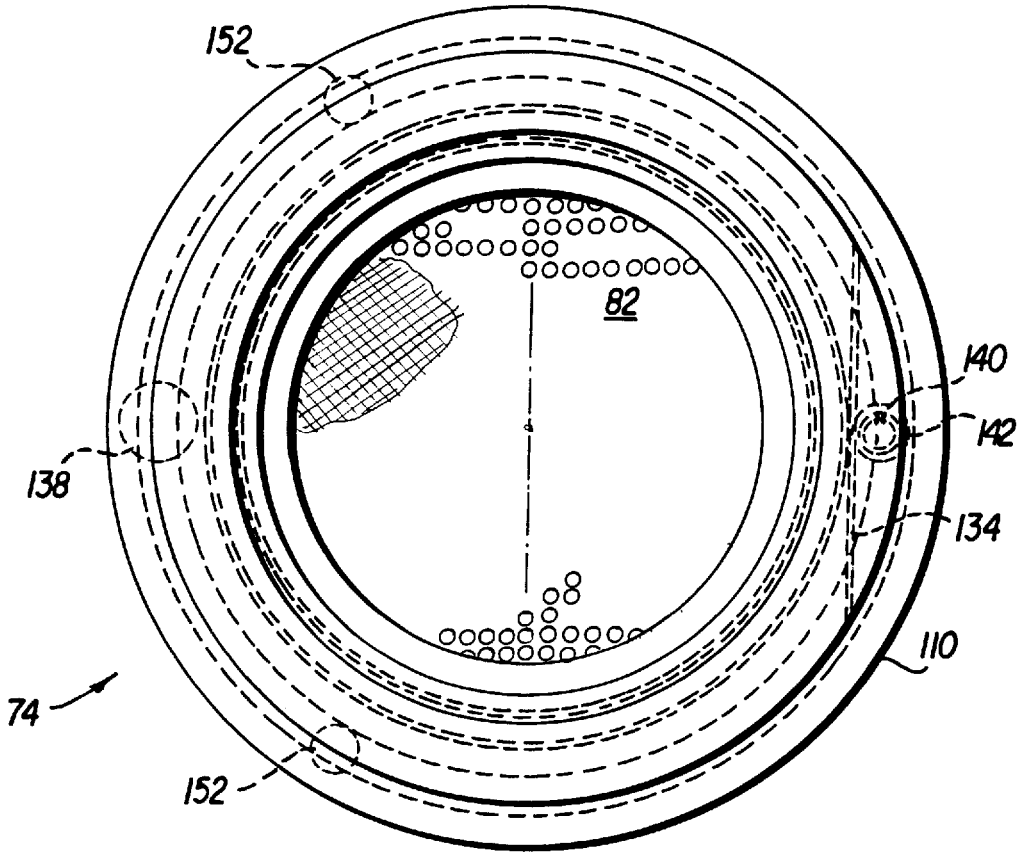
FIG. 8 is a side sectional view of a replaceable MCP cartridge according to an exemplary embodiment of the invention.
Figure 9:
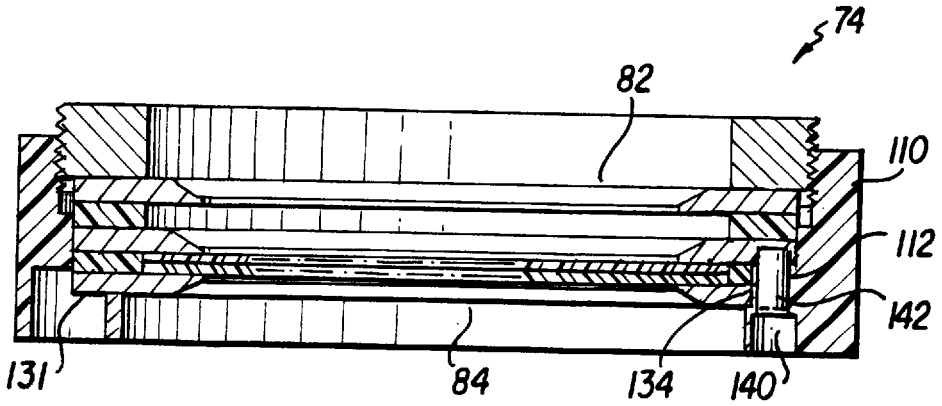
FIG. 9 is a top plan view of the cartridge shown in FIG. 8.

The cartridge 74 as illustrated in FIGS. 8–10 in respective top plan, side sectional and exploded views. The cartridge 74 includes an insulated cartridge body 110 having an interior chamber 112 for receiving the cartridge elements, including a conductive output plate 114 having a central opening, an insulating centering ring 116 having a central opening 118, a pair of opposed MCP elements 120 and 122 having a contact ring 123 disposed between the confronting surfaces of the MCP, as shown; a conductive input plate assembly 124, an insulated spacer 126, a conductive grid 128 and an insulating ring retainer 130. The ring retainer 130 is secured in the cartridge body 110 by means of mating threads 132. The centering ring 118 receives the MCPs 120,122 and contact ring 123 as a stacked array in the opening 118 which is sized for receiving the MCPs therein. The centering ring locates the MCPs 120, 122 and contact ring 123 and spaces the respective input and output electrodes 124 and 114 thereby preventing shorting.

The output plate 114 is generally circular and has an edge portion 134 removed for engaging a corresponding seat 136 in the lower portion of the cartridge body 110. A first contact opening 138 is formed in a lower portion of the cartridge body 110 and is in registration with the contact surface 130 of the resistor 120 (FIG. 6) which makes contact a corresponding portion 131 of one side of the output plate 114, as shown in the assembly drawing of FIG. 9. The housing 110 has a second contact opening 140. The input plate assembly 124 has a contact member 142 engaging the opening 140 as shown in the assembly drawing of FIG. 9. The contact member 142 engages the spring contact 104 of the high voltage connector 100 (FIG. 4). Thus, in accordance with the arrangement illustrated, a high potential difference may be established between the input plate 124 and the output plate 114. The dropping resistor or voltage divider resistor 120 establishes a relatively low negative bias on the output plate 114.

As can be seen in FIGS. 5, 6 and 8, an upper side 170 of the base 70 has upstanding registration pins 150 which mate with corresponding apertures 152 in the body 110 for locating the high and low voltage connectors as previously described. The components thus described are arranged in a stack within the body, as illustrated in FIG. 9, to thereby form a removable and replaceable cartridge assembly 74. This can be readily and easily replaced by removing the flange assembly 10 from the instrument and removing the cap 72 from detector 12 and exchanging the cartridge 74.

Figure 11:
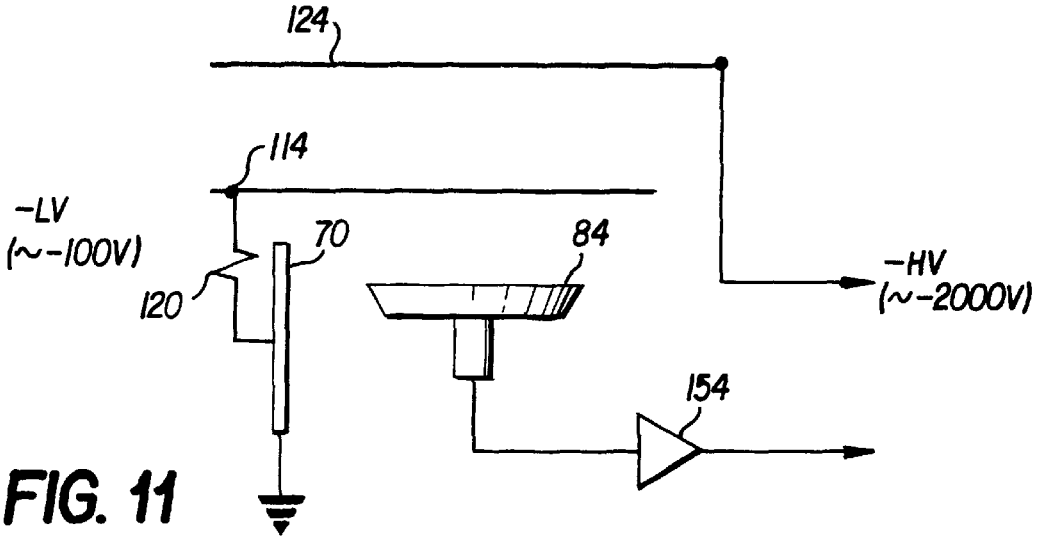
FIG. 11 is a schematic diagram of the electrical circuit of the detector shown in FIG. 1.

FIG. 11 illustrates an electrical schematic of the detector assembly 10. In the arrangement, input plate 124 has a bias of about −2,000 V, output plate 114 has a potential of about −100 V and voltage divider 120 drops the voltage to ground. The housing base 70 is at ground and the anode is electrically separated from the housing at virtual ground to form an input to a detector amplifier 154.

While there has been described what is considered to be the exemplary embodiment of the invention, it will be apparent to those skilled in the art the various changes and modifications that may be made therein without departing from the invention, and it is intended in the appended claims to cover such changes and modifications as fall within the true spirit and scope of the invention.

What is claimed is:

1. A detector assembly for a time-of-flight (TOF) mass spectrometer comprising:

a vacuum flange;

a modular detector having an input end for receiving particles adapted to be secured to the flange;

a replaceable cartridge including a MCP disposed within said detector;

high voltage connection means supported within said detector for connection to a first side of the MCP;

voltage dividing means supported within said detector; and an anode secured in confronting relation with a second side of the MCP.

2. The detector assembly of claim 1 wherein said modular detector comprises:

a base having an opening for receiving the anode in spaced relation therein; and a cap formed with a central opening for securing the cartridge between the cap and the base.

3. The detector assembly of claim 2 wherein the said voltage dividing means comprises a resistor supported within said base.

4. The detector assembly of claim 1 further comprising a shield mounted on said flange in said relation with the high voltage connection means and the input end of the detector.

5. The detector assembly of claim 1 wherein said modular detector further comprises:

an open-ended annular cap;

a base; said cap for engaging said base;

an anode supported within said base;

said high voltage connection means supported by said base, said connection means for electrically engaging a first side of said cartridge; and said voltage dividing means supported within said base, said dividing means for electrically engaging an opposite side of said first side of said cartridge.

6. The detector assembly of claim 5 wherein the anode has an input face, a tail piece and a tapered wall therebetween and the opening in the base is formed for receiving the anode in conformal spaced relation.

7. The detector assembly of claim 6 including dielectric means for spacing the anode from the opening in the detector.

8. The detector assembly of claim 7 wherein the anode has an impedance of about 50 Ω.

9. The detector assembly of claim 1 wherein said replaceable MCP cartridge further comprises:

a cartridge body;

an output plate supported within said body;

at least one MCP having an input face and an output face supported within said body, said output face engaging said output plate;

an input plate supported within said body and engaging said input face;

a spacer plate supported within said body and disposed between said input plate and said output plate; and a ring retainer for engaging said cartridge body for retaining said output plate, said spacer plate, said MCP, and said input plate.

10. The detector assembly of claim 1 wherein said replaceable MCP cartridge further comprises:

a cartridge body;

an output plate supported within said cartridge body;

first and second MCPs supported within said cartridge body, and said first MCP engaging said output plate;

an input plate supported within said body and engaging said second MCP;

a spacer plate supported within said body and disposed between said input plate and said output plate; and a ring retainer for engaging said body for retaining said output plate, said spacer plate, said first and second MCPs and said input plate.

11. The detector assembly of claim 10 further including a contact ring disposed between the MCPs.

12. The detector assembly of claim 1 wherein the anode is impedance matched.

13. A microchannel plate (MCP)-based detector for a time-of-flight (TOF) mass spectrometer, said detector comprising:

an open-ended annular cover;

a replaceable MCP cartridge disposed within said cover;

a base, said cover for engaging said base;

an anode supported by said base;

high voltage connection means supported by said base and for electrically engaging said replaceable MCP cartridge; and voltage dividing means supported within said base and for electrically engaging said replaceable MCP cartridge.

14. The detector of claim 13 further comprising:

an anode support mounted on said anode; and fastening means disposed within said base for securing said anode to said base.

15. The detector of claim 14 wherein the anode support comprises a dielectric.

16. The detector of claim 14 wherein the anode is impedance matched.

17. The detector of claim 13 wherein the detector has a relatively low profile and has a height to width ratio near one.

18. A replaceable microchannel plate (MCP) cartridge for an MCP based detector for a time-of-flight (TOF) mass spectrometer, said replaceable MCP cartridge comprising:

a cartridge body;

an output plate supported within said body;

at least one MCP having input and output faces supported within said body, said output face engaging said output plate;

an input plate supported within said body and engaging said input face;

a spacer plate supported within said body and disposed between said input plate and said output plate; and a ring retainer for engaging said cartridge body for retaining said output plate, said spacer plate, said at least one MCP, and said input plate.

19. The cartridge of claim 18 further comprising:

a grid spacer supported within said body and engaging said input plate; and a grid plate supported within said body and engaging said grid spacer.

20. The cartridge of claim 18 further comprising a spacer inserted between each of said at least one MCPs.

* * * * *